United States Patent [19]

Atwood

[11] Patent Number: 4,655,791

[45] Date of Patent: Apr. 7, 1987

[54] APPARATUS AND METHOD TO ACHIEVE GASIFICATION OF BARK AND THE LIKE

[76] Inventor: Fayette G. Atwood, Solon, Me. 04979

[21] Appl. No.: 714,885

[22] Filed: Mar. 22, 1985

[51] Int. Cl.[4] ..... C10J 3/32

[52] U.S. Cl. ..... 48/851; 48/111; 48/209; 110/258; 110/281; 432/98

[58] Field of Search ..... 48/76, 85 R, 111, 203, 48/209, 85.1; 110/248, 258, 281, 282; 432/98; 422/215, 226; 126/120

[56] References Cited

U.S. PATENT DOCUMENTS

| | | | |
|---|---|---|---|
| Re. 16,252 | 1/1926 | Catlin | 48/203 |
| 1,042,036 | 10/1912 | Rider | 126/175 |
| 2,732,837 | 1/1956 | Porwancher et al. | 126/59.5 |
| 3,746,521 | 7/1973 | Giddings | 48/111 |
| 3,885,507 | 5/1975 | Davy et al. | 110/258 |
| 4,162,655 | 7/1979 | Bozdelh et al. | 110/258 |
| 4,164,397 | 8/1979 | Hunt et al. | 48/111 |
| 4,268,275 | 5/1981 | Chittick | 48/111 |
| 4,388,082 | 6/1983 | Guttman et al. | 48/111 |

FOREIGN PATENT DOCUMENTS

| | | | |
|---|---|---|---|
| 3103721 | 12/1982 | Fed. Rep. of Germany | 48/111 |
| 7903893 | 11/1980 | Netherlands | 48/111 |
| 8200417 | 9/1983 | Netherlands | 48/111 |

*Primary Examiner*—David L. Lacey
*Attorney, Agent, or Firm*—Robert Shaw

[57] ABSTRACT

A system and method to achieve gasification of bark pieces, that includes a vessel to receive the bark pieces which are introduced at an upper region of the vessel and are burned at a lower region, which bark pieces settle from the upper region downward to the lower region in the course of burning and bridge as they settle to leave one or more bypass holes in the bulk thereof. A mechanism is provided to apply angular impelling reciprocating forces to the bark pieces or the like to revolve individual pieces through acute angles, first in one direction and then in the other, to disrupt the bridging and hence the bypass holes.

11 Claims, 4 Drawing Figures

APPARATUS AND METHOD TO ACHIEVE GASIFICATION OF BARK AND THE LIKE

The present invention relates to apparatus to manufacture fuel gas from cellulosic materials.

Attention is called to U.S. Pat. Nos. 34,731 (Brown); 1,042,036 (Rider); 2,732,837 (Porwancher et al); 4,164,397 (Hunt et al); and 4,388,082 (Guttmann et al).

A most attractive source of a combustible gas is that obtained from cellulosic materials found in wood waste, for example. A system to obtain the combustible gas in general consists of a gas-tight combustion chamber with apparatus to charge the chamber with a material to be burned to supply the heat needed to withdraw the combustible gas controllably from the wood. Air to support combustion is supplied in a controlled way. Typically the combustion chamber is vertically-oriented, circularly-cylindrical vessel into which wood waste is introduced at its upper region; a grate serves to support the wood to provide a volume of wood that usually is about ten feet in cross dimensions and about twenty-five feet high above the grate. Burning occurs at and just above the grate and the heat therefrom rises to extract a combustible gas from the wood above the combustion region. The fire, of course, extends downward into the ash region.

A partial combustion of the wood (above the combustion region) is thus obtained, whereby oxygen in the air combines with carbon in the cellulose of the wood to provide a gas mixture consisting of combustibles such as carbon monoxide (CO), hydrogen ($H_2$), nitrogen ($N_2$), hydrocarbons such as methane ($CH_4$), and non combustibles such as carbon dioxide ($CO_2$) and water vapor ($H_2O$). Methods can be employed to process the gas mixture to extend its combustible nature.

In order for the foregoing extractive process to be economically feasible, the wood waste used as a source of the combustible gas must be below a cetain cost. Thus, for example, wood chips have been used for this purpose, but wood bark which costs (in Maine) about twenty percent that of chips is a much more attractive fuel. It will be appreciated on the basis of the above explanation that in order to extract combustible gas from the waste wood the combustion gases must move upward and in intimate contact with pieces of wood to raise the temperature of the pieces to a level at which combustion gases are extracted from the pieces. This is known in the art. Unfortunately, when wood bark is the fuel used, the bark does not move downward in an acceptable fashion. Because wood bark has many burr-like edges, it does not move downwardly in a desired fashion. As a result, the individual bark pieces form mechanical bridging between pieces, resulting in a by-pass hole or channel for the rising hot combustible gases, whereby the hot gases by-pass the stacked bark pieces and do not extract combustible gases therefrom. Hence, the gases extracted from above the wood bark are combusted gases rather than combustible gas. In other words, the system becomes inoperative.

A principal objective of the present invention is to provide a system which can employ wood bark to provide a combustible gas, yet, nevertheless, does not have the by-pass problem discussed above.

Another objective is to provide a gas-extractive system, using wood bark as a fuel, yet without the problems encountered in existing systems which use wood bark and which do not function in the intended fashion.

Still other objectives are addressed hereinafter.

The foregoing objectives are attained, generally, in a system to achieve gasification of wood pieces (e.g. and preferably, wood bark and the like), which system includes a vessel to receive the wood pieces which are introduced at an upper region of the vessel to form a stack and are burned at a lower region to create hot combustion gases that rise up through the stack in intimate contact with individual wood pieces to extract gases that are removed from the vessel. As the wood pieces at the lower region burn, those above in the stack settle downwardly from the upper region toward the lower (or burning) region. In the course of settling downward the wood pieces bridge, and this is particularly true of wood bark with its thorn-like projections, leaving one or more large, generally vertical holes in the stack. The combustion gases move upwardly through the hole(s), rather than contacting the individual wood pieces, and the system becomes inoperative for its intended purpose. A reciprocating chain mechanism is provided to prevent the formation of the by-pass hole(s). The mechanism is in the form of at least one chain pair oriented across the vessel and interconnected such that when one chain of the pair moves transversely across the vessel in one direction the other chain of the pair moves transversely across the vessel in the opposite direction. The reciprocating movement of the chains serves to apply angular impelling forces on the individual wood pieces which revolve through angles, first in one direction and then in the other to disrupt the bridging action that otherwise would occur. The reciprocating or revolving movement of the wood pieces typically is through an acute angle.

The invention is hereafter described with reference to the accompanying drawing in which.

Figure 1:
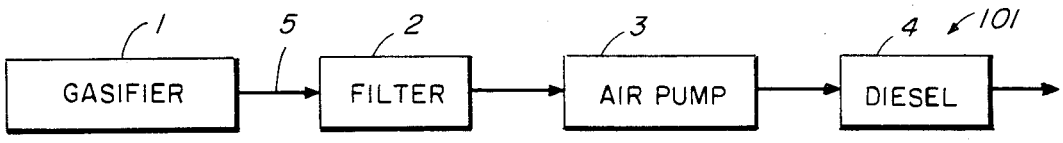
FIG. 1 is a diagrammatic representation of a system to gasify wood objects, which system includes a gasifier.

Turning first to FIG. 1, the system labeled 101 is one adapted to provide a combustible gas which is withdrawn at 5 (see also FIG. 2) by an air pump 3 through a filter 2 and introduced to a diesel 4, for example, where it serves as a fuel together with a small amount of diesel fuel. A system like 101 has great attractiveness in paper mills and similar industries which produce large amounts of wood wastes in their processing. Wood bark is a most attractive waste because of the large volume produced and cheap price, particularly since it can be used where produced, reducing transportation costs. The diesel 4 can be used to drive an electric alternator for local power or power to sell.

Figure 2:
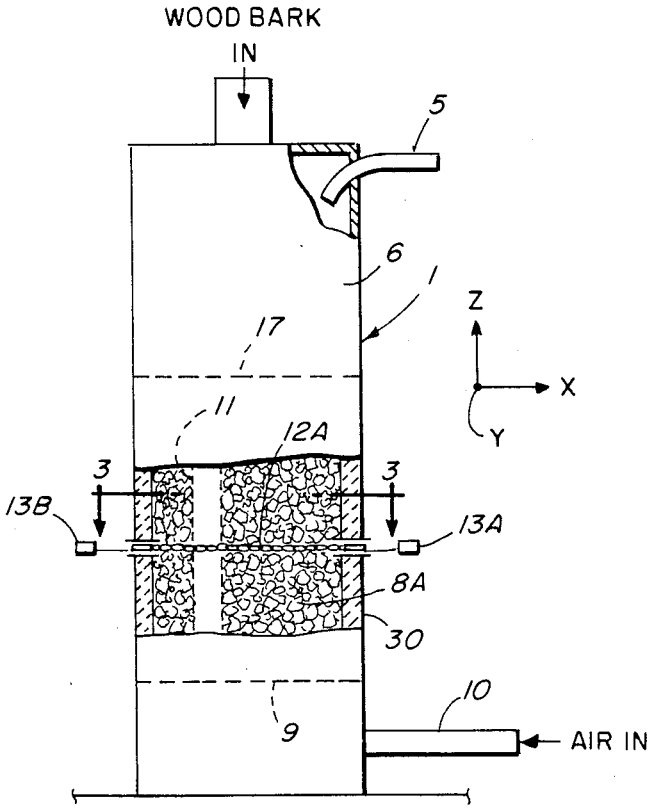
FIG. 2 is an elevation view, partly cutaway, showing the gasifier portion of the system of FIG. 1.

While the present invention has broader implications, it is described hereinafter primarily in the context of wood bark for which it is mostly peculiarly well adapted. The gasifier 1 is shown in FIG. 2 to be a large vertically-oriented, circularly-cylindrical structure or vessel. Wood bark pieces may be as much as six inches long and four inches wide, as represented at 8 in the cutaway mid-part of the cylindrical structure 1. The bark 8 drops by gravity onto a grate 9 where combustion takes place; air, in controlled amounts, is drawn in at 10 to permit the combustion which is more like smouldering.

Heated gases from the combustion (or smouldering) are drawn up through the bark pieces 8 withdrawing from the wood the methane (and other gases) which is later burned in the diesel engine 4, for example, to produce electric energy. It has been found, however, that as the bark pieces 8 settle downward in the course of combustion, one or more holes having a vertical component in the bark mass form (e.g., the hole labeled 11 drawn in broken-line representation); hence the hot gases pass upwardly mostly through hole 11, by-passing the bark pieces and the gasifier 1 becomes inoperative for its intended purpose. It is toward preventing formation of the hole (or holes) 11, that the present invention is directed.

Figure 3:
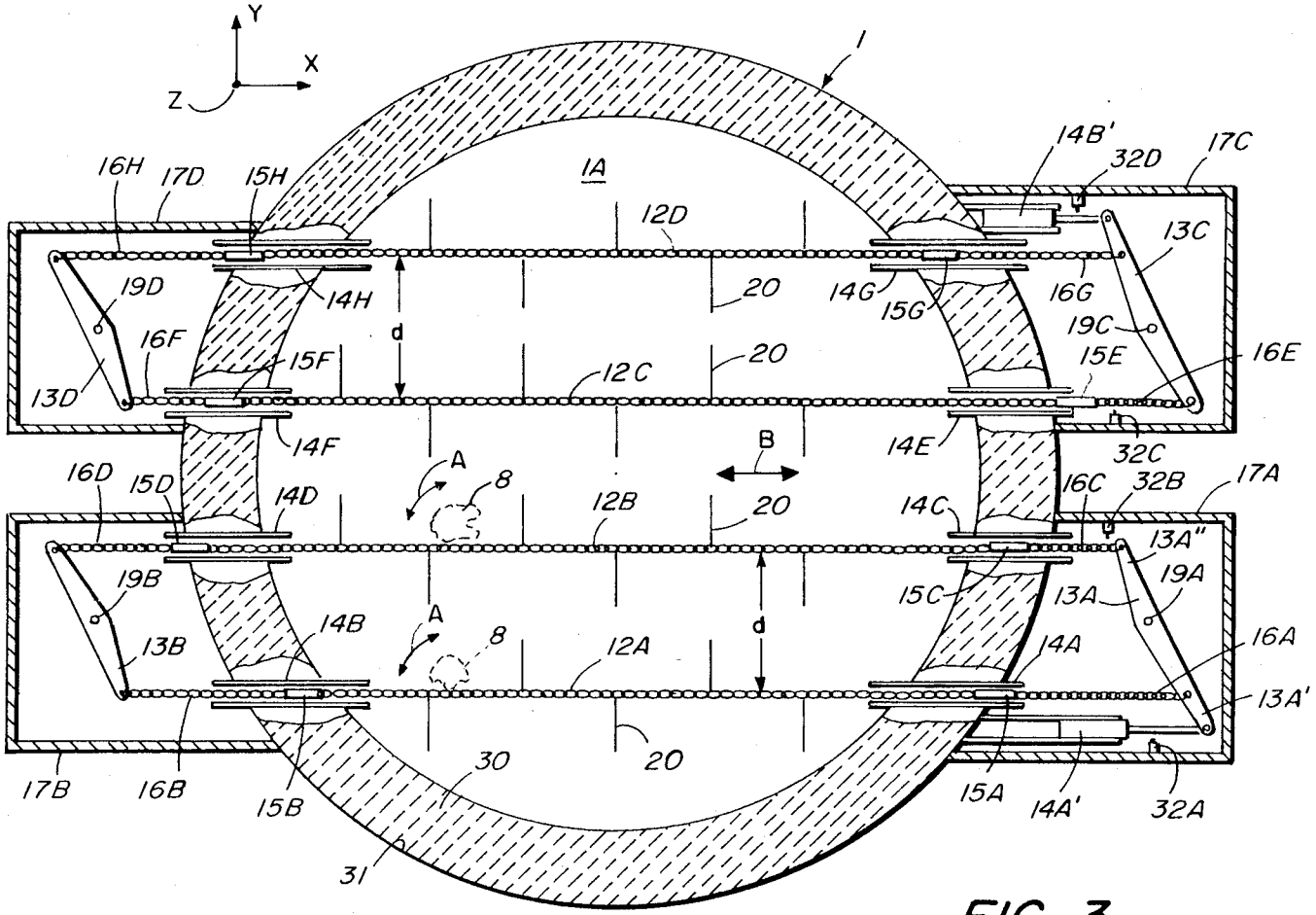
FIG. 3 is an enlarged section view, partly diagrammatic in form and partly cutaway, taken on the line 3—3 FIG. 2, looking in the direction of the arrows and showing reciprocating chain pairs.

The present inventor has found that the hole 11 can be prevented by applying reciprocating angular forces on the individual bark pieces, causing individual bark pieces to revolve through an arc of ten to forty degrees of mechanical motion, first in one direction (e.g., clockwise) and then in the other (e.g., counter-clockwise). The reciprocating angular motion is achieved by chain-pairs of the type shown in FIG. 3 which is an enlarged section view taken on the line 3—3 in FIG. 2 looking in the direction of the arrows. To place this explanation in context, the gasifier vessel 1 is typically about ten to twelve feet in diameter. The wall labeled 30 in FIG. 3 is about a foot thick; it is made of fire brick (or other refractory material) with an external insulator 31. Hot gases move out of the paper (Z-direction) in FIG. 3.

The chain marked 12A in FIG. 2 is shown as two chain-pairs 12A–12B and 12C–12D in FIG. 3. The chains are moved in reciprocating motion (±direction) by rocker arms 13A–13B and 13C–13D, acting in pairs. Forces are applied by double-acting, fluid actuated cylinders (air or hydraulic) 14A′ and 14B′ to the rocker arms 13A and 13C, respectively, the arms 13B and 13D being idlers. The rocker arms rotate about shafts 19A–19D. Linear motion of the chains 12A–12D is about one foot to the left in FIG. 3 and then one foot to the right (see the double arrow labeled B in FIG. 3). Reciprocating angular motion of the two wood pieces 8 adjacent the chains 12A and 12B is shown by the double arrows marked A; that reciprocating angular motion is shown to be in the X-Y plane and to be counterclockwise and clockwise. It has been found, for present purposes, that such reciprocating angular motion of the individual wood piece breaks bridging which otherwise would occur and, thus, prevents formation of the holes that would otherwise occur in the stacked bark within the cylindrical vessel 1.

Since the interior designated 1A of the vessel 1 is under a slight vacuum, connections from the chains 12A–12D within the vessel to the rocker arms 13A–13D must be through a seal. The exit is a two-inch (inner diameter) pipe (14A–14H) through the wall 30 of the vessel 1. Each chain is connected at each end thereof to a solid cylindrical member (15A–15H) whose outer diameter is just slightly less than the two-inch inner diameter of the pipe (i.e., 1 7/8 inches). The other end of each cylindrical member 15A–15H is connected by a chain (16A–16H) to the associated rocker arm (13A–13D). In this way forces can be transmitted from outside the vessel 1 to the chains within while maintaining a seal of the interior 1A.

The two chain pairs, as above noted, each consists of two chains oriented in the same orientation across the vessel 1 such that all the chains 12A–12D are substantially parallel to another and in the X-Y plane which is substantially orthogonal to the axis of the cylindrical vessel 1. The spacing labeled d in FIG. 3 between chains of each pair should be the same spacing as that between chain pairs, that is, the inner chain 12C of one pair is the same spacing d from the chain 12B as it is from the chain 12D. Furthermore, the inner chain 12C is subjected to reciprocating movement relative to the inner chain 12B. The timing of the relative reciprocating movement of the two inner chains 12B and 12C is adjusted or controlled to provide movement of one inner chain of one pair (e.g., the chain 12B) in one direction when the inner chain of the other pair (e.g., the chain 12C) is in the opposite direction. Movement of the rocker arms 13A–13D can by synchronized by limit switches 32A–32D, known in this art, to provide the required timing of the chains of each pair. Thus in the system shown in FIG. 3, the inner chains 12B and 12C interact with each other to apply revolving forces to the wood bark pieces 8 with the chains 12A and 12D, respectively.

Each chain pair, as above indicated, is connected to a pair of rocker arms located outside the cylindrical vessel 1 and transversely spaced across the vessel, one rocker arm, e.g., the arm 13A, being diametrically spaced across the circular cylindrical vessel 1 from the other rocker arm of the pair, e.g., the rocker arm 13B. One chain of the pair (e.g., the chain 12A) is attached at one far end (e.g., the end labeled 13A′ of the arm 13A) and the other chain of the pair (e.g., the chain 12B) is attached to the other far end (e.g., the end labeled 13A″ of the arm 13A) of each rocker arm. One fluid actuated cylinder (e.g., the cylinder 14A′ which preferably is a double-acting, air actuated cylinder) is connected to one rocker arm (e.g., the rocker arm 13A) to drive that arm and provide the necessary reciprocating transverse movements. The rocker arms 13B and 13D are idler arms, as indicated previously.

The chains are located at an intermediate region above the burning, as shown in FIG. 2; the atmosphere in that intermediate region must be controlled to provide proper combustible gas extraction. An important aspect of the invention is the provision of proper air seals between the individual chains and the associated rocker arms, the air seals being provided by the hollow cylinders 14A–14H and the solid cylinders 15A–15H, respectively, which are connected to the associated chain at one end thereof and to the far end of the associated rocker arm at the other end thereof to permit transverse forces to be applied between the chain and the rocker arm without permitting free access of air to the interior of the vessel. Typically the chain pairs are located four to five feet above the grate 9 and about six feet below the upper level shown at 17 of the wood stack marked 8A, leaving a five foot gas space above the wood stack.

Figure 4:
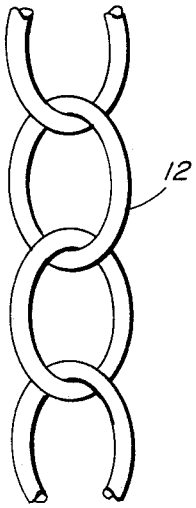
FIG. 4 shows a short length of one chain in FIG. 3.

In one form of the invention, short angle-iron rods 20 (FIG. 3) are welded to the chains and are spaced along the particular chain, as shown. The rods 20 typically are welded to the associated chain and typically are about six inches long; but the chains are the most important aspect with respect to applying angular forces to the wood pieces 8. The link chain labeled 12 in FIG. 4 may be any of the chains 12A–12D. It may be, for example, a 3/8 high-test chain. The short reciprocating action of the chains 12A–12D is typically translational movement of about one foot, as above noted. Control of the reciprocating motion is through electrical control circuitry (not shown) by use of limit switches 32A–32D which typically are microswitch. The labels 17A–17D apply to enclosures (not shown in FIG. 2) around the arms 13A–13D and related parts; each enclosure 17A–17D has a cover (removed in FIG. 3) which can be made substantially air-tight to serve as an air seal.

Further modifications of the invention herein disclosed will occur to persons skilled in the art and all such modifications are deemed to be within the scope of the invention as defined by the appended claims.

What is claimed is:

1. A system to achieve gasification of bark pieces, that comprises:

a vessel to receive the bark pieces which are introduced at an upper region of the vessel and are burned at a lower region below said upper region, which bark pieces settle from the upper region downward to the lower region in the course of burning, which bark pieces tend to bridge as they settle to leave a bypass hole in the bulk thereof;

means to effect combustion of the bark pieces at said lower region;

a reciprocating chain mechanism comprising a pair of chains oriented across the vessel and interconnected such that when one chain of the pair moves transversely across the vessel in one direction the other chain of the pair moves transversely across the vessel in the opposite direction, the reciprocating movement of the chains serving to apply angular impelling forces on the bark pieces whereby the individual pieces thereof are turned through angles, first in one direction and then in the other direction, to disrupt said bridging.

2. A system according to claim 1 that further includes means to reciprocate the reciprocating chain mechanism to revolve the individual bark pieces through acute angles during said reciprocating movement.

3. A system according to claim 1 in which the vessel is a vertically oriented cylinder, and in which the chain mechanism comprises chain pairs, each of said chain pairs being oriented in the same orientation across the vessel such that all chains are substantially parallel to one another and in a plane that is substantially orthogonal to the vertical axis of the vertically oriented cylinder.

4. A system according to claim 3 in which each chain pair comprises an outer chain and an inner chain, in which spacing between the chain pairs in said plane is about the same spacing as between chains of each pair, the inner chain of one pair being arranged so as to be subjected to reciprocal movement relative to the inner chain of the other pair, said system including timing means to provide timed reciprocating movement so that timing of relative reciprocating movement of the two inner chains is adjusted to provide reciprocating movement of one inner chain or one pair in one direction when the inner chain of the other pair is moving in the opposite direction.

5. A system according to claim 1 that includes a pair of rocker arms located outside the vessel and transversely spaced from one another across the vessel, one chain of the pair of chains being attached at one far end of each rocker arm of the pair of rocker arms and the other chain of the pair of chains being attached at the other far end of each said rocker arm.

6. A system according to claim 5 in which the reciprocating chain mechanism further includes fluid actuated cylinder means connected to drive one of said rocker arms of the pair to provide the reciprocating movement, the other arm of the pair being an idler arm.

7. A system according to claim 6 in which the chains of the chain pair are located in an intermediate region above the said lower region at which said combustion occurs and between the upper region and the lower region, the atmosphere in the intermediate region being a controlled atmosphere and in which connections between each individual chain and each rocker arm pass through a seal which prevents uncontrolled entry of air into the vessel.

8. A system according to claim 7 in which each said seal comprises a horizontally disposed hollow cylinder and a solid cylinder disposed within the hollow cylinder and free to move axially along the hollow cylinder and in which the solid cylinder is connected to one of said chains at one end thereof and to the far end of one of said rocker arms at the other end thereof to permit transverse forces to be applied between the chain and the rocker arm without permitting free access of air to the interior of the vessel.

9. A system according to claim 8 in which the vessel is a vertically oriented circular cylindrical vessel whose walls are insulated, in which, in an operating system, bark pieces are stacked within the cylindrical vessel to a height of about ten feet, in which the chain pairs are disposed about four to five feet above the lower region at which burning occurs and between the lower region and the upper region, in which the inner diameter of the circular cylindrical vessel is about ten feet, in which combustion gas from the burning moves upward and in intimate contact with individual bark pieces in the stack to extract combustible gases from the bark pieces, and in which the combustible gases are removed from the region within the vessel above the stacked bark pieces.

10. A system according to claim 1 in which each of said chains of the pair of chains has several spaced, parallel metal rods connected to lie perpendicular to each of said chains to aid in preventing bridging.

11. A system according to claim 10 in which each of said rods is an angle iron member about six inches long.

* * * * *